US006039271A

United States Patent [19]

Reiter

[11] Patent Number: 6,039,271

[45] Date of Patent: Mar. 21, 2000

[54] FUEL INJECTION VALVE

[75] Inventor: Ferdinand Reiter, Markgroeningen, Germany

[73] Assignee: Robert Bosch GmbH, Stuttgart, Germany

[21] Appl. No.: 09/051,123

[22] PCT Filed: Mar. 15, 1997

[86] PCT No.: PCT/DE97/00533

§ 371 Date: Apr. 1, 1998

§ 102(e) Date: Apr. 1, 1998

[87] PCT Pub. No.: WO98/05859

PCT Pub. Date: Feb. 12, 1998

[30] Foreign Application Priority Data

Aug. 1, 1996 [DE] Germany ..... 1 96 31 066

[51] Int. Cl.[7] ..... B05B 1/30; F02M 51/06

[52] U.S. Cl. ..... 239/585.4; 239/533.11; 239/533.12; 239/585.1; 239/590.3

[58] Field of Search ..... 239/585.1, 585.4, 239/858.5, 596, 533.11, 533.12, 590.3; 29/890.142, 890.143; 251/129.21

[56] References Cited

U.S. PATENT DOCUMENTS

| | | | |
|---|---|---|---|
| 4,967,959 | 11/1990 | Wieczorek | 239/585.1 X |
| 4,971,254 | 11/1990 | Daly et al. | 239/585.1 X |
| 5,002,231 | 3/1991 | Reiter et al. | 239/585.1 |
| 5,174,505 | 12/1992 | Shen | 239/585.1 X |
| 5,263,648 | 11/1993 | Vogt et al. | 239/585.1 X |
| 5,330,153 | 7/1994 | Reiter | 239/585.4 X |
| 5,437,413 | 8/1995 | Shen et al. | 239/585.4 X |
| 5,465,910 | 11/1995 | Hall et al. | 239/585.4 |
| 5,484,108 | 1/1996 | Nally | 239/585.4 X |
| 5,570,843 | 11/1996 | Heyse et al. | 239/585.4 X |
| 5,662,277 | 9/1997 | Taubitz et al. | 239/585.4 |
| 5,678,767 | 10/1997 | Rahbar | 239/585.1 X |
| 5,755,386 | 5/1998 | Lavan et al. | 239/585.1 X |
| 5,765,750 | 6/1998 | Pace et al. | 239/585.4 X |

*Primary Examiner*—Andres Kashnikow
*Assistant Examiner*—Steven J. Ganey
*Attorney, Agent, or Firm*—Edwin E. Greigg; Ronald E. Greigg

[57] ABSTRACT

A fuel injection valve for internal combustion engines is already known in which the valve seat body is produced by multiple complicated work processes. In the novel valve, a valve seat body of simple design that can be made economically is used. The valve seat body (16) is made from sheet metal by stamping and deep drawing and has a cup shape with a bottom (19) of the seat body and an annular edge (20) of the seat body. A valve seat (24) is formed in the bottom (19) of the seat body. An injection port disk (34) is joined by welding to the valve seat body (16). The fuel injection valve is especially suitable for fuel injection systems of mixture-compressing internal combustion engines with externally supplied ignition (FIG. 1).

4 Claims, 2 Drawing Sheets

FUEL INJECTION VALVE

PRIOR ART

The invention is based on a fuel injection valve as generically defined by the preamble to claim 1. A fuel injection valve is already known (German Patent Application DE 42 21 185 A1) in which the valve seat body is produced by complicated work processes, which along with the relatively high material costs also leads to relatively high production costs.

ADVANTAGES OF THE INVENTION

The fuel injection valve according to the invention having the definitive characteristics of claim 1 has the advantage over the prior art that the valve seat body can be produced in a simple, material-saving way, and particularly in large-scale mass production, this leads to a significant cost savings. Designing the valve seat body of sheet metal not only makes for easy machinability and low weight of the valve seat body but also reduces the amount of material required.

By means of the provisions recited in the dependent claims, advantageous refinements of and improvements to the fuel injection valve defined by claim 1 are possible.

It is advantageous to weld an injection port disk, which has at least one injection port used for fuel metering, to the bottom of the cup-shaped valve seat body, downstream of the valve seat.

It is also advantageous to support a guide disk on the annular-edged end face of the valve seat body in order to guide the valve closing body.

With the interposition of a support ring engaging the injection port disk, it is also advantageous to retain the valve seat body in the valve housing by means of a crimp on the valve housing.

DRAWING

Exemplary embodiments of the invention are shown in simplified form in the drawing and explained in further detail in the ensuing description. FIG. 1 shows a first exemplary embodiment of the invention in terms of a fuel injection valve shown schematically and in fragmentary fashion; and FIG. 2 shows a second exemplary embodiment of the invention in a fragmentary view of a fuel injection valve.

DESCRIPTION OF THE EXEMPLARY EMBODIMENTS

Figure 1:
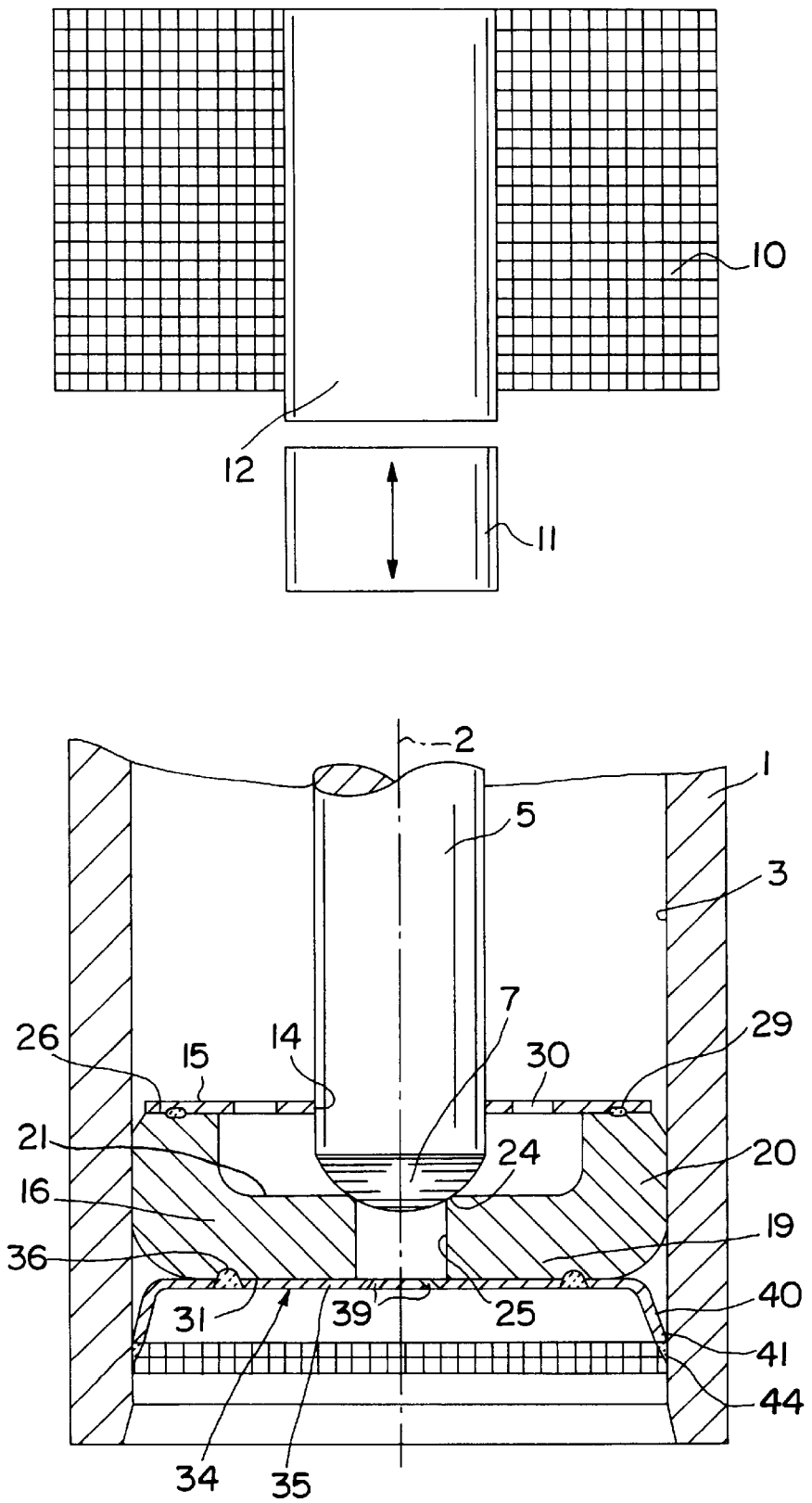

In FIG. 1, an example of an otherwise already known fuel injection valve for fuel injection systems of mixture-compressing internal combustion engines with externally supplied ignition is shown in fragmentary form; it is embodied according to the invention as the first exemplary embodiment. The fuel injection valve has a tubular valve housing 1, in which a longitudinal opening 3 is formed, concentric with a longitudinal valve axis 2. A valve needle 5, for instance of rodlike shape, is disposed in the longitudinal opening 3, and its downstream end is embodied as a spherical portion that serves as a valve closing body 7.

The fuel injection valve is actuated in a known manner, for instance electromagnetically. For axially moving the valve needle 5 and thus opening the fuel injection valve counter to the spring force of a restoring spring, not shown, or closing the fuel injection valve, and electromagnetic circuit shown in suggested fashion in the drawing is used, having a magnet coil 10, an armature 11, and a core 12. The armature 11 is connected to the end of the valve needle 5 remote from the valve closing body 7, for instance by means of a welded seam, and is aimed at the core 12.

For guiding the valve needle 5 and thus the valve closing body 7 during the axial motion along the longitudinal valve axis 2, a guide opening 14 of a guide disk 15 that rests on a valve seat body 16 is used. The valve seat body 16 is inserted into the downstream end, remote from the core 12, of the valve housing 1 into the longitudinal opening 3 that extends concentrically with the longitudinal valve axis 2. The valve seat body 16 is cup-shaped and has a bottom 19 of the seat body, which is located crosswise to the longitudinal valve axis 2, and an annular edge 20 of the seat body, extending in the direction of the longitudinal valve axis 2. Embodied in an upper bottom face 21 of the bottom 19 of the seat body, which face is oriented toward the annular edge 20 of the seat body, is a valve seat 24, which is adjoined in the downstream direction by an outflow opening 25 that penetrates the bottom 19 of the seat body. The valve closing body 7 cooperates with the valve seat 24 by resting on the valve seat 24 when the valve is closed and lifting from it when the valve is opened. The valve seat 24 is formed by the intersecting edge between the upper bottom face 21 and the outflow opening 25. The width of the valve seat face that cooperates with the valve closing body 7 is approximately 0.05 mm to 0.1 mm and is created for instance by lapping, using a ball or a cone as a tool. The diameter of the outflow opening 25 is approximately 0.8 mm to 1.5 mm. The guide disk 15 rests on an annular-edged end face 26, remote from the bottom 19 of the seat body, of the annular edge 20 of the seat body and is joined to that face by a weld 29 either in the form of a spot weld or an encompassing welded seam. Flow opening 30 in the guide disk 15 enable a flow of fuel from the longitudinal opening 3 to the valve seat 24. The valve seat body 16 is made from a sheet, for instance of stainless steel, that is approximately 0.8 mm to 1.5 mm thick, specifically by being stamped and deep drawn and then hardened. The circumference of the annular edge 20 of the seat body has a slightly smaller diameter than the longitudinal opening 3 of the valve housing 1, so that the valve seat body 16 can be inserted into the longitudinal opening 3. Resting on a lower bottom face 31, remote from the annular edge 20 of the seat body, of the bottom 19 of the seat body is an injection port disk 34, which in the exemplary embodiment of FIG. 1 is cup-shaped and has a bottom part 35 resting on the lower bottom face 31, which part is tightly joined to the bottom 19 of the seat body by means of a welded bottom seam 36 extending all the way around. In the region covered by the outflow opening 26, the bottom part 35 of the injection port disk 34 has at least one injection port 39, and for instance four injection ports 39, formed by erosion or by being stamped out.

The bottom part 35 of the cup-shaped injection port disk 34 is adjoined by an encompassing retaining rim 40, which extends axially away from the valve seat body 16 and is bent conically outward as far as its end 41. Since the circumferential diameter of the valve seat body 16 is smaller than the diameter of the longitudinal opening 3 of the valve housing 1, only a radial pressure prevails between the longitudinal opening and the retaining rim 40, bent slightly conically outward, of the injection port disk 34. The insertion depth of the valve seat part, comprising the valve seat body 16 and the cup-shaped injection port disk 34, into the longitudinal opening determines the preset stroke length of the valve needle 5, since one terminal position of the valve needle 5 is fixed, when the magnet coil 10 is not excited, by the contact of the valve closing body 7 with the valve seat face 24 of the valve seat body 16. The other terminal position of the valve needle is fixed, when the magnet coil 10 is excited, for instance by the contact of the armature 11 with the core 12. The distance between these two terminal positions of the valve needle 5 is thus the stroke length.

On its end 41, the retaining rim 40 of the injection port disk 34 is joined tightly and firmly to the wall of the longitudinal opening 3. To that end, an encompassing retaining welded seam 44 is provided between the end 41 of the retaining rim 40 and the well of the longitudinal opening 3. A tight connection of the valve seat body 16 and the injection port disk 34, and of the injection port disk 34 and the valve housing 1, is necessary so that the fuel cannot flow between the longitudinal opening 3 of the valve housing 1 and the circumference of the valve seat body 16 to reach the injection ports 39, or between the longitudinal opening 3 of the valve housing 1 and the retaining rim 40 of the cup-shaped injection port disk 34, to flow directly into an air intake line of the engine.

Figure 2:
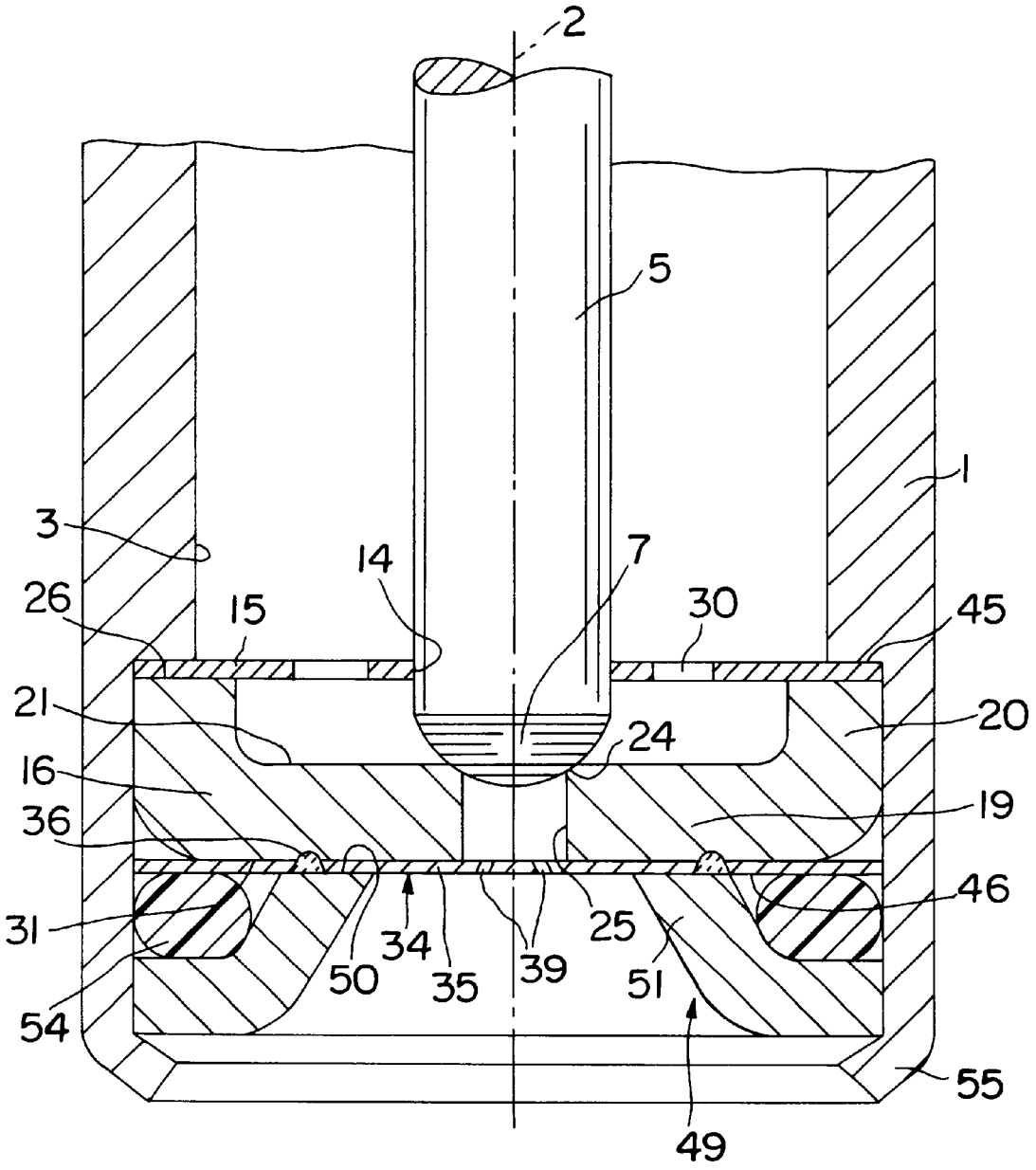

In the exemplary embodiment of FIG. 2, those parts that remain the same and function the same as in the exemplary embodiment of FIG. 1 are identified by the same reference numerals. In a departure from the exemplary embodiment of FIG. 1, in the exemplary embodiment of FIG. 2 the longitudinal opening 3 in the valve housing 1 is embodied in stepped fashion and has an increased circular cross section, beginning at an encompassing edge 45 of the valve housing. The guide disk 15 rests on the valve housing edge 45, and the valve seat body 16 rests with the annular-edged end face 26 on the guide disk. A weld 29 between the guide disk 15 and the valve seat body 16 is not contemplated in this exemplary embodiment. Nor is the injection port disk 34 cup-shaped; instead, it is embodied as a flat disk. Resting on a lower end face 46 of the injection port disk 34, remote from the valve seat body 16, is a support ring 49 with a support face 50, which is embodied on a support edge 51, bent toward the valve seat body 16, of the support ring 49. A sealing ring 54 is disposed between the flat injection port disk 34 and the support ring 49. On the side of the support ring 49 remote from the valve seat body 16, a crimp 55 is provided on the valve housing 1; it exerts a force in the direction toward the valve housing edge 45 upon the support ring 49, as a result of which the support ring 49 presses the valve seat body 16 and the guide disk 15 against the valve housing edge 45 and thus fixes them in that position.

I claim:

1. A fuel injection valve for internal combustion engines comprising a valve housing, a movable valve closing body, which cooperates with a valve seat (24) that is embodied on a valve seat body (16) and downstream merges with an outflow opening, the valve seat body (16), comprising sheet metal, has a cup-shape produced by deep drawing and has a bottom (19) of the seat body and an annular edge (20) of the seat body extending axially from said bottom (19), the valve seat (24) is formed on an upper bottom face (21), toward the annular edge (20) of the seat body, of the bottom (19) of the seat body, and said upper bottom face (21) is embodied as a flat surface between the annular edge (20).

2. The fuel injection valve in accordance with claim 1, characterized in that an injection port disk (34) with at least one injection port (39) covered by the outflow opening (25) rests on and is welded to a lower bottom face (31) of the bottom (19) of the seat body, which bottom face is remote from the annular edge (20) of the seat body of the valve seat body (16).

3. The fuel injection valve in accordance with claim 2, characterized in that a support ring (49) is retained in the valve housing (1) by means of a crimp (55) provided on the valve housing (1) and engages the injection port disk (34) in such a way that the valve seat body (16) is pressed with its annular edge (20) of the seat body against a valve housing edge (45).

4. The fuel injection valve in accordance with claim 1, characterized in that the valve closing body (7) protrudes through a guide opening (14) of a guide disk (15), which rests on an annular-edged end face (26) of the annular edge (20) of the seat body.

* * * * *